United States Patent [19]

Mahar et al.

[11] Patent Number: 4,572,304

[45] Date of Patent: Feb. 25, 1986

[54] PORTABLE SEABED PENETRATION SYSTEM

[75] Inventors: Larry J. Mahar; Bruce J. Douglas, both of Long Beach, Calif.

[73] Assignee: The Earth Technology Corporation, Long Beach, Calif.

[21] Appl. No.: 633,407

[22] Filed: Jul. 23, 1984

[51] Int. Cl.[4] ..... E21B 19/08; B63B 21/27

[52] U.S. Cl. ..... 175/5; 114/296; 175/7; 175/203

[58] Field of Search ..... 175/5, 203, 7, 18, 162, 175/135; 114/396

[56] References Cited

U.S. PATENT DOCUMENTS

| | | | |
|---|---|---|---|
| 3,687,205 | 8/1972 | Mori | 175/5 X |
| 3,965,687 | 6/1976 | Shaw | 61/46 |
| 4,004,532 | 1/1977 | Reynolds | 175/5 X |
| 4,124,989 | 11/1978 | Watson et al. | 405/225 |
| 4,270,480 | 6/1981 | Hancock et al. | 114/296 |
| 4,318,641 | 3/1982 | Hogervorst | 405/224 |
| 4,403,658 | 9/1983 | Watkins | 175/7 X |
| 4,432,671 | 2/1984 | Westra et al. | 405/226 |

*Primary Examiner*—Stuart S. Levy
*Assistant Examiner*—Thomas R. Hannon
*Attorney, Agent, or Firm*—Fulwider, Patton, Rieber, Lee & Utecht

[57] ABSTRACT

A readily portable seabed penetration system for conducting cone penetrometer tests or the like from a support disposed above the water over the portion of the seabed to be penetrated. The system includes a casing string connected at its upper end to the support and at its lower end to a suction anchor. A string of push rods encased within the casing string is provided at its lower end with a penetrometer cone. With the suction anchor evacuated, the lower end of the casing is securely anchored to the seabed. Upward tension is then applied to the casing while downward force is applied to the rod string to drive the penetrometer cone into the seabed. The rod string is supported against buckling by the tensioned casing string.

7 Claims, 8 Drawing Figures

PORTABLE SEABED PENETRATION SYSTEM

BACKGROUND OF THE INVENTION

The present invention relates to an improved system for penetrating the seabed utilizing a readily portable, rapidly operable apparatus.

It is often necessary to install instruments or conduct penetration testing into the seabed in connection with oil exploration. Such seabed testing in near-freezing Artic ocean water presents serious problems, particularly where such testing must take place from a moving ice field. Conventional rotary drilling is impractical because the moving ice will break the drillrods before boring can be completed. It has been proposed to conduct such seabed testing utilizing conventional cone penetrometer apparatus, since the test could be completed sufficiently fast enough to match the movement of the ice. Conventional cone penetrometer testing would only be feasible, however, in extremely shallow water. In deeper water, it is not possible to push the penetrometer cone into the seabed because of the flexibility of the pentrometer rods.

SUMMARY OF THE INVENTION

It is a major object of the present invention to provide a seabed penetration system which may be utilized in deep water.

It is a more particular object of the present invention to provide a seabed penetration system for conducting cone penetrometer tests or the like or for installing seabed instrumentation from a support disposed above the water over the portion of the seabed to be penetrated. The system includes a casing string connected at its upper end to the support and at its lower end to a suction anchor. A string of push rods encased within the casing string is provided at its lower end with a device to be penetrated. After the suction anchor has been evacuated to securely anchor the lower end of casing string to the seabed, upward tension is applied to the casing string while downward force is applied to the push rod string to thereby drive the device into the seabed with the push rod string being supported against buckling by the casing string.

Yet another object of the present invention is to provide a seabed penetration system of the aforedescribed nature which is readily portable to remote locations, as by means of a helicopter.

Yet another object of the present invention is to provide a seabed penetration system of the aforedescribed nature which permits the seabed penetration operation to take place in a minimum amount of time thereby permitting the system to be operated from a moving ice field.

A further object of the present invention is to provide a seabed penetration system of the aforedescribed nature that is simple of design and foolproof in operation, even under adverse weather conditions.

These and other objects and advantages of the present invention will become apparent from the following detailed description and the accompanying drawings.

DETAILED DESCRIPTION OF A PREFERRED EMBODIMENT

Figure 1:
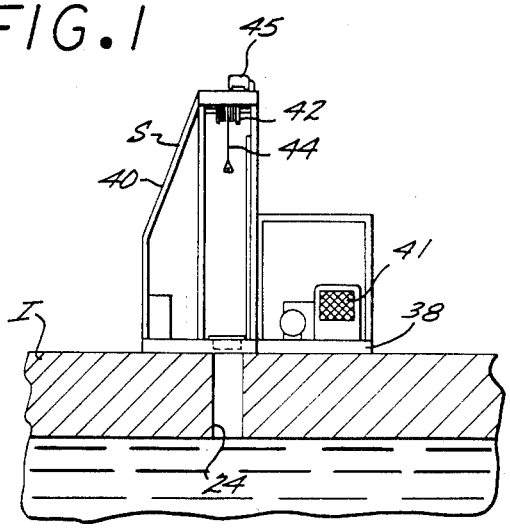
FIG. 1 is a side elevational view of a preferred form of seabed penetration system embodying the present invention disposed upon a body of ice in preparation for operation.

Referring to the drawings, a preferred seabed penetration system embodying the present invention includes a support, generally designated S, shown disposed upon a floating body of ice I over the portion of the seabed B to be penetrated. The upper end of a multisection casing string, generally designated 20, depends from support S. A conventional suction anchor, generally designated 22 is secured to the lower end of the casing string. The casing string 20 extends through an aperture 24 formed in the body of ice I. A string of push rods, generally designated 28, is slidably encased within the casing string 20. The lower end of the push rod string is provided with a seabed penetrating member, such as a conventional penetrometer cone 30. Evacuation of the suction anchor 22 securely anchors the lower end of the casing string 20 to the seabed B.

Figure 2:
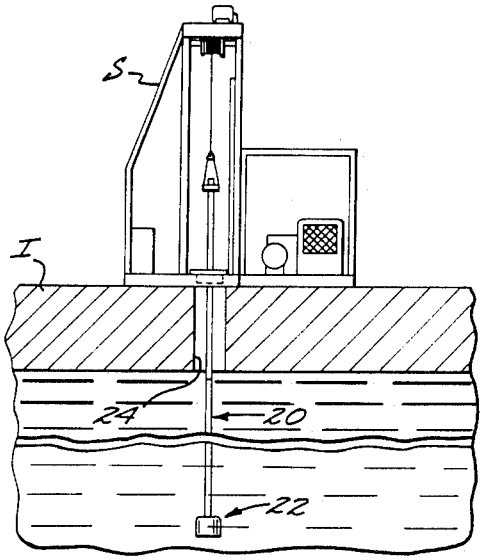
FIG. 2 is a side elevational view similar to FIG. 1 but showing the casing string being lowered to the seabed.
Figure 4:
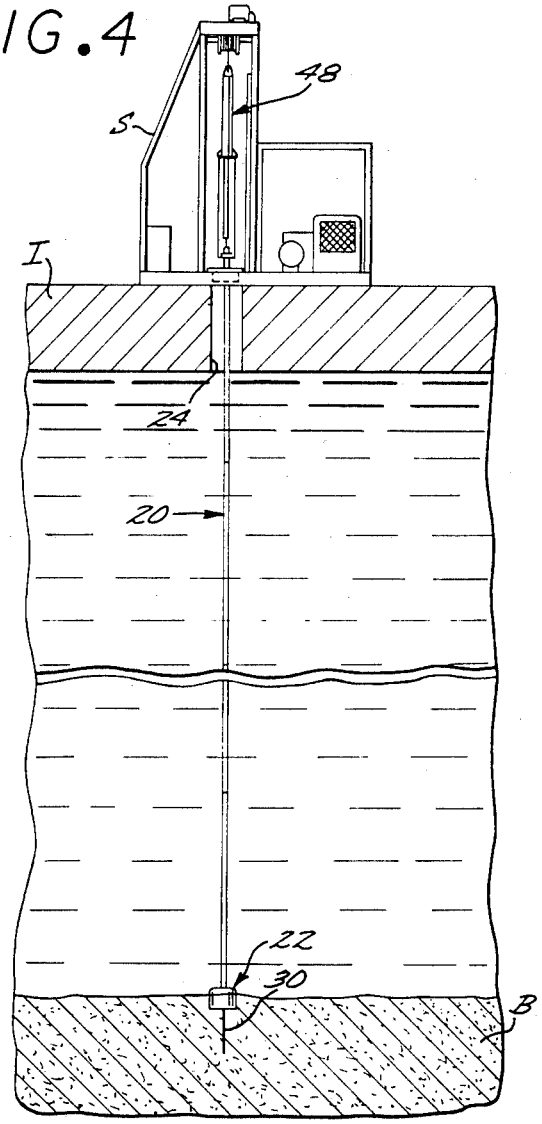
FIG. 4 is a side elevational view similar to FIGS. 1, 2, and 3 showing the components of said system during penetration of a seabed.
Figure 8:
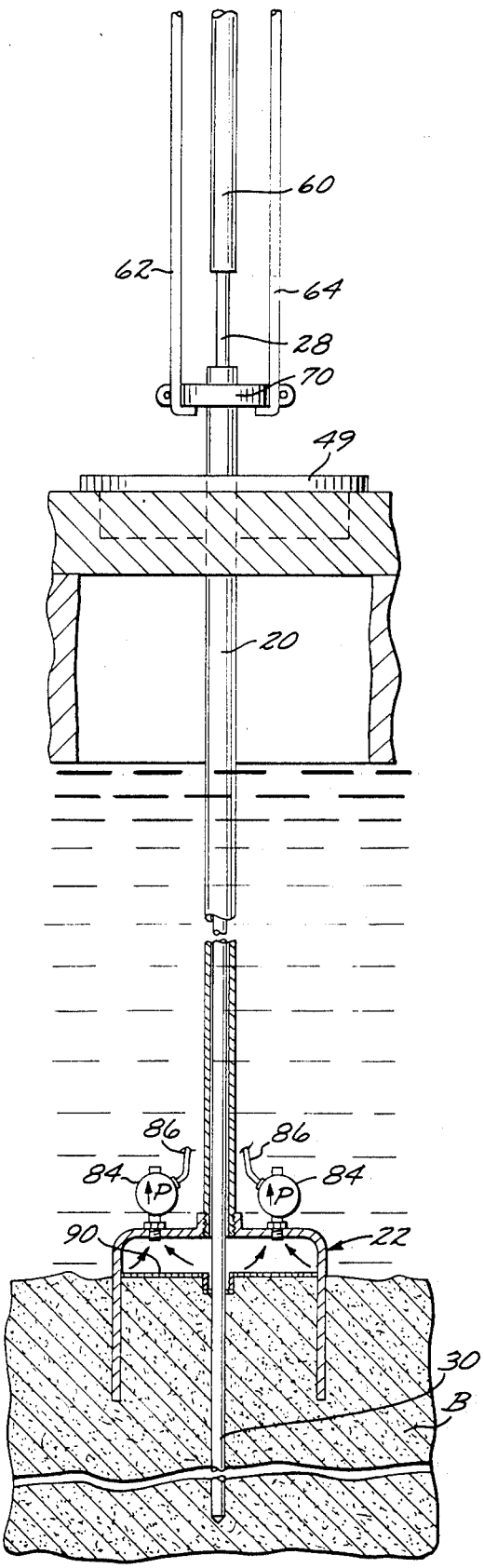

In conducting a seabed penetration operation, the casing string 20 and its attached suction anchor 22 is extended downwardly toward the seabed B by adding casing lengths to the casing string in a conventional manner. Thereafter, the suction anchor 22 is evacuated so as to securely anchor the lower end of the casing string to the seabed. The push rod string 28 is extended downwardly through the casing string by consecutively connecting together sections of push rods in a conventional manner. As indicated in FIG. 2, a power winch 42 and its cable 44 may be utilized in lowering and raising the casing string through the ice. Such winch and cable may also be employed in lowering and raising the push rod string. The push rod string 28 and its attached probe are lowered through the casing string until the cone 30 is disposed within the confines of the suction anchor 22. Upward tension is then applied to the casing string 20 while downward force is applied to the push rod string 28 so as to drive the cone 30 into the seabed, as indicated in FIGS. 4 and 8. Buckling of the push rod string 28 by the imposition of downward force upon the upper end thereof will not result in buckling of such push rod string since such string is supported against buckling by virtue of its confinement within the casing string 20. After the penetration testing has been completed, the push rod string 28 is retracted to the surface. The suction anchor 22 is then re-pressurized and the casing string 20 is likewise raised to the surface.

More particularly, the support S includes a horizontal base 38 upon which rests a frame 40. Base 38 supports an internal combustion engine 41 which powers a conventional electric generator, air compressor, and hydraulic motors also disposed upon the platform. The upper portion of frame 40 carries a high-speed hydraulic winch 42 about which is wrapped a flexible element such as a cable 44. Winch 42 is driven by hydraulic motor 45. The cable 44 is attached to the upper end of a hydraulic ram unit, generally designated 48. The hydraulic ram unit 48 is disposed above a table 49 removably arranged in a cavity 50 formed in the base 38.

Figure 5:
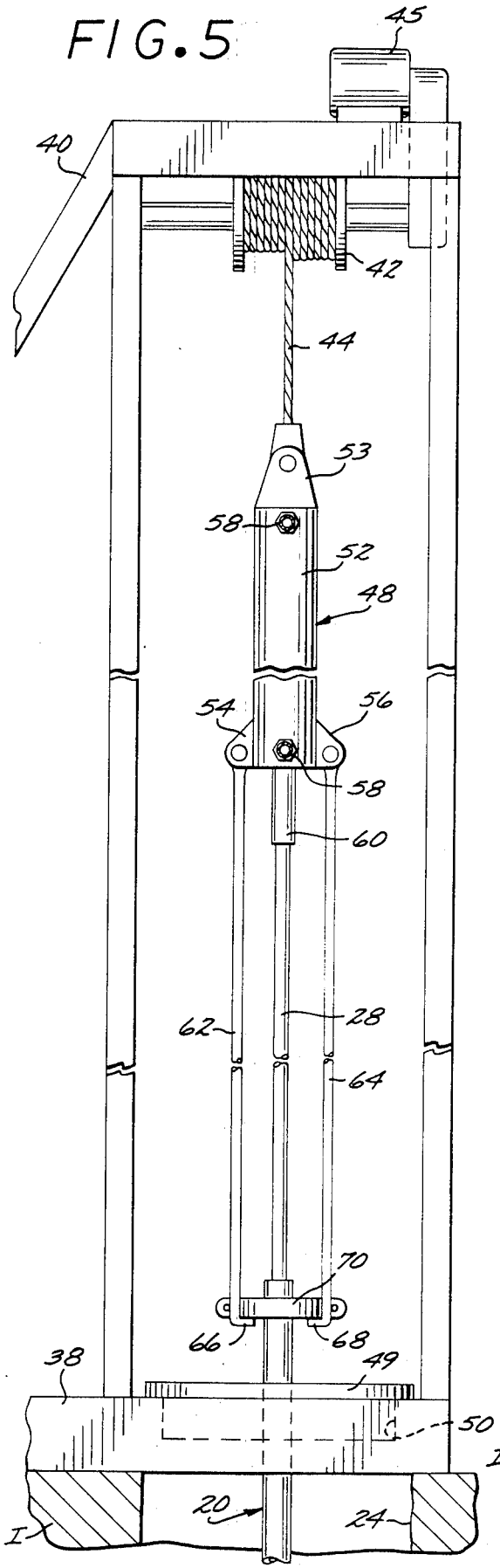
FIGS. 5 and 6 are a broken side elevational view taken in enlarged scale of the above-water components of said system during a seabed penetration operation.
Figure 6:
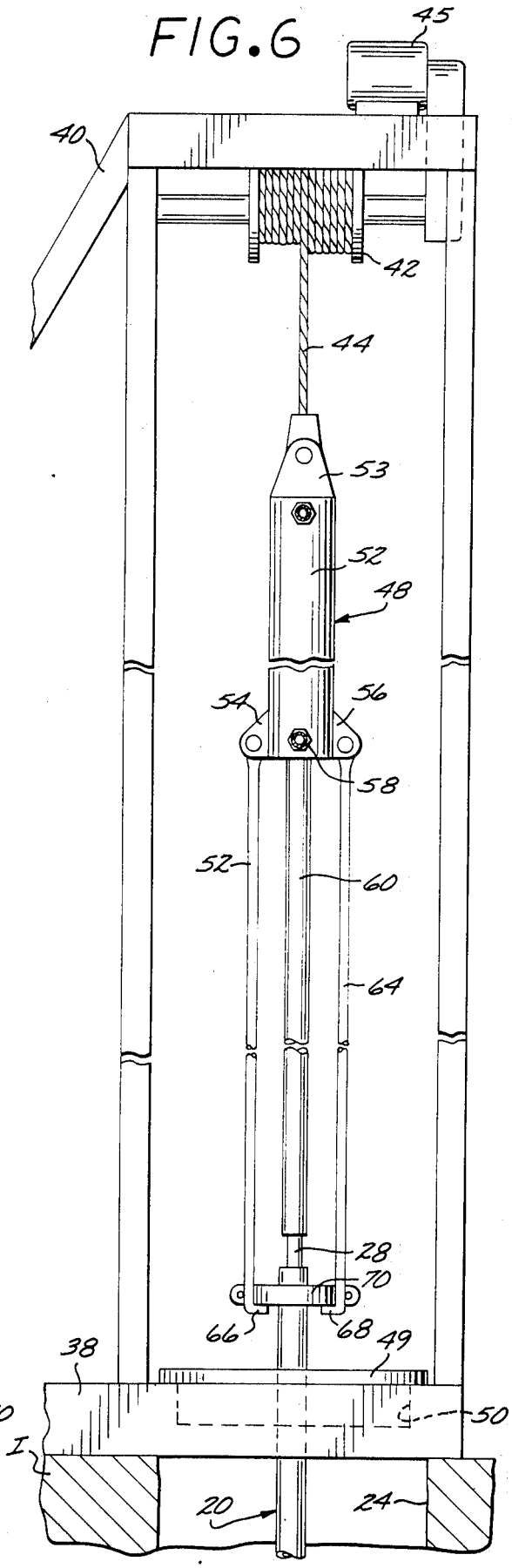

Referring particularly to FIGS. 5 and 6, hydraulic ram 48 includes a cylinder 52, the upper end of which is provided with a fitting 53 removably attached to the cable 44. The lower end of cylinder 52 is formed with a pair of ears 54 and 56, respectively. The upper and lower portions of cylinder 52 are provided with fittings 58 which are engageable with conventional hydraulic pressure lines (not shown) for effecting vertical movement of the plunger member 60 of the ram 48 towards and away from the lower end of cylinder 52 in a conventional manner. The lower portion of plunger 60 is removably engageable with the upper end of push rod string 28. A pair of tension links 62 and 64 are removably affixed at their upper ends to ears 54 and 56, respectively. The lower ends of such tension links are provided with in-turned fingers 66 and 68. Such fingers removably engage and support the opposite sides of a conventional pipe elevator 70. The pipe elevator 70 is engagable with the casing string 20 so as to support such casing string against downward movement.

Figure 3:
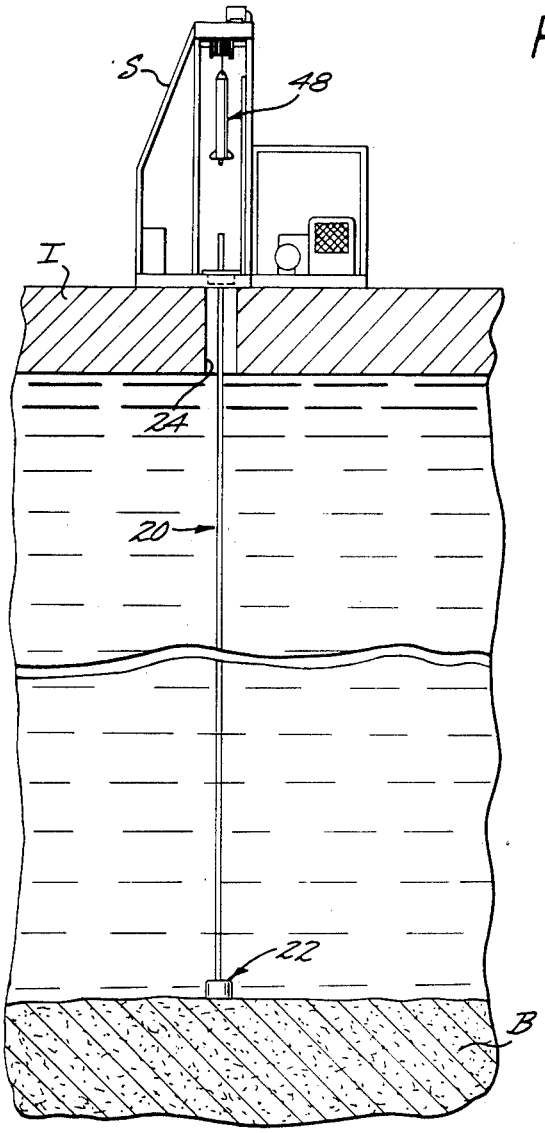
FIG. 3 is a side elevational view similar to FIGS. 1 and 2 showing the casing string and its attached suction anchor engaging the seabed.
Figure 7:
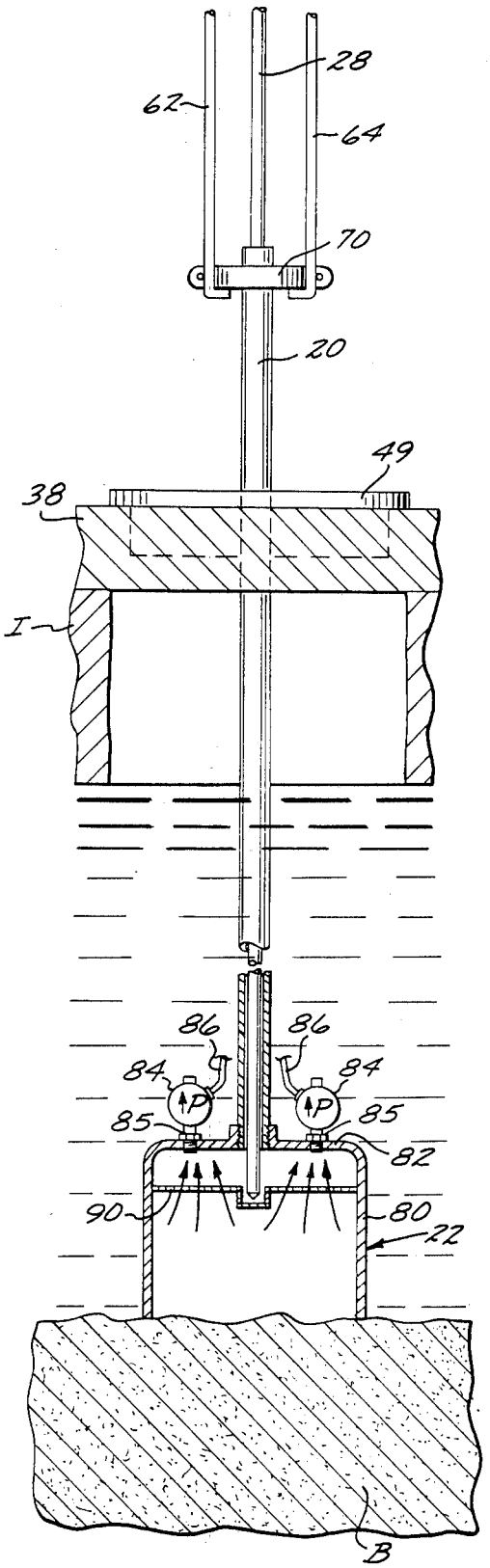
FIGS. 7 and 8 are broken side elevational views taken in enlarged scale particularly showing the submerged components of said system during a seabed penetration operation.

Referring now particularly to FIGS. 7 and 8, the suction anchor 22 is of inverted cup-shaped configuration and includes cylindrical side walls 80 integral with a horizontal top wall 82, the lower end of such suction anchor being open. One or more conventional fluid pumps 84 are secured to the top wall 82 by a pipe 85. Each pump is provided with a power line (either air or electric) 86 which operate the pumps 84 in a conventional manner. The lines 86 may be raised or lowered by a conventional power winch (not shown). It should be noted that the pumps 84 and power lines 86 are not shown in FIGS. 2, 3, and 4 in the interest of clarity. The upper interior portion of suction anchor 22 is provided with a soil filter plate 90.

In the operation of the aforedescribed seabed penetration system, the support S is transported to the site where the seabed penetration is to take place. In the embodiment shown in the drawings, the support S rests upon a floating ice bed I. Preferably, the support S, as well as the other components of the seabed penetration system, will be made of light-weight materials, such as aluminum, to permit the support to be deployed to the work site by helicopter. The aperture 24 is first formed through the ice. Such aperture must exceed the diameter of the suction anchor 22. The table 49 is shown in general vertical alignment with the aperture 24. After ice aperture 24 is formed, the lowermost casing length and suction anchor 22 connected thereto is lowered through the ice aperture. Thereafter, the casing string 20 (preferably of the flush joint type) is made up in a conventional manner. The threaded ends of the casing lengths may be initially rotated by hand so as to connect one length of casing to the other. Thereafter, the threaded casing joints are tightened by means of a wrench (not shown).

With the suction anchor 22 resting upon the upper surface of the seabed B, the upper end of the casing string 20 extends above the table 49. Pumps 84 are then actuated so as to evacuate the water from within the suction anchor, as indicated by the directional arrows in FIG. 7. Such evacuation causes the suction anchor to be drawn downwardly with its side walls 80 penetrating the seabed until the soil plate anchor 90 engages the upper surface of the seabed. The soil filter plate restrains flow of seabed particles into the pumps 84 so as to prevent pumping of soil out of the anchor into the sea. The embeded suction anchor 22 securely anchors the lower end of casing string 20 to the seabed, as indicated in FIGS. 4 and 8. Thereafter, the push rod string 28 with its penetrometer cone 30 secured to the lower end thereof is lowered through casing string 20 until the cone 30 is disposed just above the seabed. The upper end of push rod string 28 is then secured to the lower end of hydraulic ram plunger 60, as indicated in FIG. 5. As also indicated in FIG. 5, the upper length of casing string 20 is securely engaged with elevator 70. The elevator 70 is supported by the tension links 62 from the ears 54 and 56 of cylinder 52 of hydraulic ram 48. Thereafter, the ram plunger 60 is extended from the cylinder 52 so as to urge the push rod string 28 downwardly. Such downward movement of the plunger 60 concurrently effects tensioning of the casing string 20 through the tension links 62 and 64. The compressive effect of the plunger on the push rod string is substantially equal to the tensioning effect applied to the casing string. Note also that the upper end of casing string 20 could be temporarily locked to the support so as to be tensioned by downward movement of the suction anchor 22 into the seabed, with downward force then being applied to the upper end of the push rod string 28 to drive the probe 30 into the seabed.

The downward movement of push rod string 28 serves to force the cone 30 downwardly into the seabed, as indicated in FIG. 8. When the testing has been completed, the push rod string 28 and cone 30 will be raised to the surface, preferably utilizing the winch 42 and cable 44. Thereafter, the pumps 84 are again actuated so as to force sea water into the confines of the suction anchor 22. This influx of sea water serves to lift the suction anchor upwardly out of the seabed. The suction anchor and the casing string 20 are then recovered, preferably utilizing the power winch 42 and cable 44. The length of cable 44 between winch 42 and ram 48 will be maintained with a constant tension level to provide for upward movement of the casing string 20 when the suction anchor is evacuated. The various components of the preferred form of seabed penetration system may then be quickly removed from the initial testing site and deployed to another site or to the home base.

It should be noted that although the support S is shown disposed upon a floating bed of ice I, such support could also be transported to the work site by means of a vessel. Alternatively, the support could be carried on a structure which is fixed relative to the seabed. It should additionally be noted that while there has been disclosed hereinbefore a seabed penetration system adapted for use with a penetrometer cone, such system could also be utilized with other types of testing equipment, such as a sampler tool. Alternatively, the system could be utilized for temporarily or permanently embedding a monitoring instrument or the like in the seabed.

Various other modifications and changes may be made with respect to the foregoing detailed description, without departing from the spirit of the present invention.

We claim:

1. A seabed penetration system, comprising:

a support disposed over the portion of the seabed to be penetrated;

a casing string depending from said support;

a suction anchor secured to the lower end of said casing string;

a push rod string slideably extending from said support through said casing string to the seabed;

a seabed penetration member on the lower end of said push rod string;

pump means in communication with the interior of said suction anchor to evacuate the latter and thereby temporarily anchor said casing string to the seabed; and means on said support connected to the upper ends of said casing string and said push rod string to concurrently tension said casing string and urge said push rod string downwardly to thereby effect penetration of the seabed by said seabed penetrating member, with said push rod string being restrained against buckling by said casing string.

2. A seabed penetration system as set forth in claim 1 wherein said seabed penetrating member is a penetrometer cone.

3. A seabed penetration system as set forth in claim 1 wherein said last-mentioned means includes a power-operated ram having a cylinder attached to said casing string and a plunger attached to said push rod string.

4. A seabed penetration system as set forth in claim 3 wherein said ram is suspended from said support by a flexible element which permits upward movement of said ram relative to said support.

5. A seabed penetration system as set forth in claim 1 wherein last-mentioned means is movable upwardly relative to said support.

6. A method of penetrating the seabed below a body of water with a seabed penetrating member, said method including the steps of:

lowering a suction anchor through the water to the upper surface of the seabed on a casing;

inserting a push rod string that carries the seabed penetrating member downwardly through said casing until the penetrating member is adjacent the seabed;

evacuating the suction anchor to temporarily secure the lower end of the casing string to the seabed; and tensioning the casing string while forcing the push rod string downwardly to embed the penetrating member in the seabed to thereby prevent buckling of the push rod string.

7. A method of penetrating the seabed below a body of water with a seabed penetrating member, said method including the steps of:

lowering a suction anchor through the water to the upper surface of the seabed on a casing;

inserting a push rod string that carries the seabed penetrating member downwardly through said casing until the penetrating member is adjacent the seabed;

evacuating the suction anchor to temporarily secure the lower end or the casting string to the seabed; and tensioning the casing string while forcing the push rod string downwardly to embed the penetrating member in the seabed to thereby prevent buckling of the push rod string;

retrieving the push rod string upwardly through the casing string;

admitting water to the suction anchor; and retrieving the casing string and suction anchor.

* * * * *